US012759745B2

(12) United States Patent
De Diego Mateos et al.

(10) Patent No.: US 12,759,745 B2
(45) Date of Patent: Oct. 13, 2026

(54) PROCESS AND MACHINE FOR FILLING A CONTAINER WITH INSECT LARVAE

(71) Applicant: MEALFOOD EUROPE S.L., Doñinos de Salamanca (ES)

(72) Inventors: Sabas De Diego Mateos, Doñinos de Salamanca (ES); Adriana Casillas Barros, Doñinos de Salamanca (ES); Ramir Abordan Bernal, Doñinos de Salamanca (ES)

(73) Assignee: MEALFOOD EUROPE S.L., Doñinos de Salamanca (ES)

( * ) Notice: Subject to any disclaimer, the term of this patent is extended or adjusted under 35 U.S.C. 154(b) by 237 days.

(21) Appl. No.: 18/556,571

(22) PCT Filed: Apr. 20, 2021

(86) PCT No.: PCT/ES2021/070261
§ 371 (c)(1),
(2) Date: Apr. 26, 2024

(87) PCT Pub. No.: WO2022/223853
PCT Pub. Date: Oct. 27, 2022

(65) Prior Publication Data
US 2024/0308706 A1 Sep. 19, 2024

(51) Int. Cl.
*B65B 35/28* (2006.01)
*B65B 35/06* (2006.01)

(52) U.S. Cl.
CPC ..... *B65B 35/28* (2013.01); *B65B 35/06* (2013.01)

(58) Field of Classification Search
CPC ..... B65B 35/28; B65B 35/06; B65B 5/068; A01K 67/30
See application file for complete search history.

(56) References Cited

U.S. PATENT DOCUMENTS 2,859,689 A * 11/1958 Ackley ..... B41F 17/36 101/35
2,901,209 A * 8/1959 Bardy ..... F42B 33/0207 141/144
3,868,900 A * 3/1975 Ackley ..... B41F 17/36 118/62

(Continued)

FOREIGN PATENT DOCUMENTS

WO 2006018142 A1 2/2006

*Primary Examiner* — Thomas M Wittenschlaeger
*Assistant Examiner* — Katie L Gerth
(74) *Attorney, Agent, or Firm* — Hayes Soloway PC

(57) ABSTRACT

Process and machine for filling a container with insect larvae, wherein the process includes supplying the larvae to a hopper arranged adjacent to a roller having lines of openings, applying a vacuum inside the roller for adhering the larvae to the openings, moving the container in a forward direction towards the roller, the container moved through an area below the roller and the roller arranged in a position transverse to the forward movement direction, synchronized rotating of the roller with the forward movement of the container from a loading position to an unloading position in which one of the lines of openings faces the compartments of one of the rows of the container, and removing the vacuum from the line of openings in order to release the larvae, with one larva being arranged in each compartment in the row of the container.

5 Claims, 7 Drawing Sheets

(56) References Cited

U.S. PATENT DOCUMENTS 3,889,591 A * 6/1975 Noguchi ..... B41F 17/36 198/380
3,933,239 A * 1/1976 Yoshida ..... A61J 3/074 198/384
4,231,462 A * 11/1980 Ackley, Sr. ..... B65G 47/1471 198/380
4,632,028 A * 12/1986 Ackley ..... A61J 3/074 198/397.06
4,731,979 A * 3/1988 Yamamoto ..... A61J 3/074 53/529
5,826,633 A * 10/1998 Parks ..... B65B 9/042 141/237
6,286,421 B1 * 9/2001 Ackley ..... B41F 17/36 101/35
6,357,495 B1 * 3/2002 Baroncini ..... B65B 35/06 222/230
6,837,281 B2 * 1/2005 Spiers ..... B65B 1/366 141/286
7,102,741 B2 * 9/2006 Ackley, Jr. ..... G01N 21/9508 209/580
7,255,247 B2 * 8/2007 Aylward ..... B65B 35/08 221/277
8,266,874 B2 * 9/2012 Runft ..... A61J 3/074 53/900
8,291,916 B2 * 10/2012 Belcastro ..... A24C 5/475 131/342
8,373,081 B2 * 2/2013 Ackley ..... B07C 5/362 209/580
8,590,582 B2 * 11/2013 Jackels ..... B65G 29/00 141/81
11,006,662 B1 * 5/2021 Williams ..... A24D 3/0287
2005/0217207 A1 * 10/2005 Konishi ..... A61J 3/074 53/53
2011/0016834 A1 * 1/2011 Rapparini ..... B65B 29/022 53/510
2012/0028774 A1 * 2/2012 Ercelebi ..... A24D 3/0287 493/47
2013/0206484 A1 * 8/2013 Consoli ..... A61J 3/074 177/1
2014/0123601 A1 * 5/2014 Murokh ..... B23K 26/355 53/411
2014/0239006 A1 * 8/2014 Garthaffner ..... B65G 47/1428 221/265

* cited by examiner

PROCESS AND MACHINE FOR FILLING A CONTAINER WITH INSECT LARVAE

CROSS-REFERENCE TO RELATED APPLICATIONS AND PRIORITY

This patent application claims priority from PCT Application No. PCT/ES2021/070261 filed Apr. 20, 2021.

TECHNICAL FIELD

The present invention relates to a process and a machine for filling a container with insect larvae.

PRIOR STATE OF THE ART

The current state of animal nutrition, especially in relation to sectors as important as aquaculture or poultry farming, presents serious problems related to obtaining the proteins necessary to provide a good diet for animals. In this field, an alternative to achieving healthy nutrition is to use insects as a base and/or food supplement. In addition, the use of insects as food brings with it a significant number of environmental, health, social and life benefits, which also makes insect-based nutrition an appropriate solution to solve problems related to human nutrition.

The metamorphosis process of insects is an essential phase in their life cycle. In this phase, insects go from the larval stage to the pupal stage, where the larva is covered with a protective shell and remains in a dormant state, to reach the adult stage after metamorphosis.

During the breeding process, the larvae about to enter the pupal stage are separated from the rest of the larvae and placed in a new container where they complete their transition to the pupal stage and undergo metamorphosis. In some cases, the newly emerged adults attack the other larvae that have not completed metamorphosis, so the number of larvae that transform into adults may be reduced. To avoid this problem, the larvae are separated manually and placed in individual containers to undergo metamorphosis, so adult insects are isolated in their respective container, preventing them from harming the rest of the larvae. This manual process is not productive, so it is generally only applied in aggressive insect species where the decrease in the insect population can be considerably affected by cannibalism, while, in other less aggressive species, the loss of population due to cannibalism is considered acceptable, and all the larvae are treated together in the same container without separation.

DESCRIPTION OF THE INVENTION

The object of the invention is to provide a process and a machine for filling a container with insect larvae, as defined in the claims.

One aspect of the invention relates to a process for filling a container with insect larvae, wherein the container has a plurality of compartments distributed in rows for receiving a larva in each compartment, the process comprising:

- supplying the larvae to a hopper which is arranged adjacent to a roller having lines of openings on the outer surface thereof for adhering a larva at each opening,
- applying a vacuum inside the roller for adhering the larvae to the openings,
- moving the container in a forward movement direction towards the roller, the container being moved through an area below the roller and the roller being arranged in a transverse position with respect to the forward movement direction,
- rotating the roller in a manner that is synchronized with the forward movement of the container from a loading position in which the larvae from the hopper are adhered to the openings of the roller to an unloading position in which one of the lines of openings of the roller faces the compartments of one of the rows of the container, and
- removing the vacuum from the line of openings in the unloading position in order to release the larvae, with one larva being arranged in each compartment of the row of the container.

Another aspect of the invention relates to a machine for filling a container with insect larvae, wherein the container has a plurality of compartments distributed in rows for receiving a larva in each compartment, the machine comprising a hopper for receiving the larvae, a roller which is arranged adjacent to the hopper and has lines of openings on its outer surface for adhering a larva at each opening, a vacuum pump for applying a vacuum inside the roller and adhering the larvae to the openings, a conveyor belt for moving the container according to a forward movement direction towards the roller, the container being moved through an area below the roller and the roller being arranged in a transverse position with respect to the forward movement direction of the container, and rotation means for rotating the roller in a manner that is synchronized with the forward movement of the container from a loading position in which the larvae from the hopper are adhered to the openings of the roller to an unloading position in which one of the lines of openings of the roller faces the compartments of one of the rows of the container, such that when the vacuum is removed from the line of openings in the unloading position, the larvae are released, with one larva being arranged in each compartment of the row of the container.

In this way, the larvae are automatically arranged in the compartments of the container, where they undergo metamorphosis individually, thus leaving the newly emerged adults isolated from the rest of the larvae. Cannibalism is thereby avoided and the percentage of larvae that reach the adult stage is efficiently increased.

These and other advantages and features of the invention will become evident in view of the figures and the detailed description of the invention.

DETAILED DESCRIPTION OF THE INVENTION

The invention relates to a process and a machine for filling a container 1 with insect larvae 2, more particularly larvae of *Tenebrio molitor* (commonly called mealworm).

Figure 2:
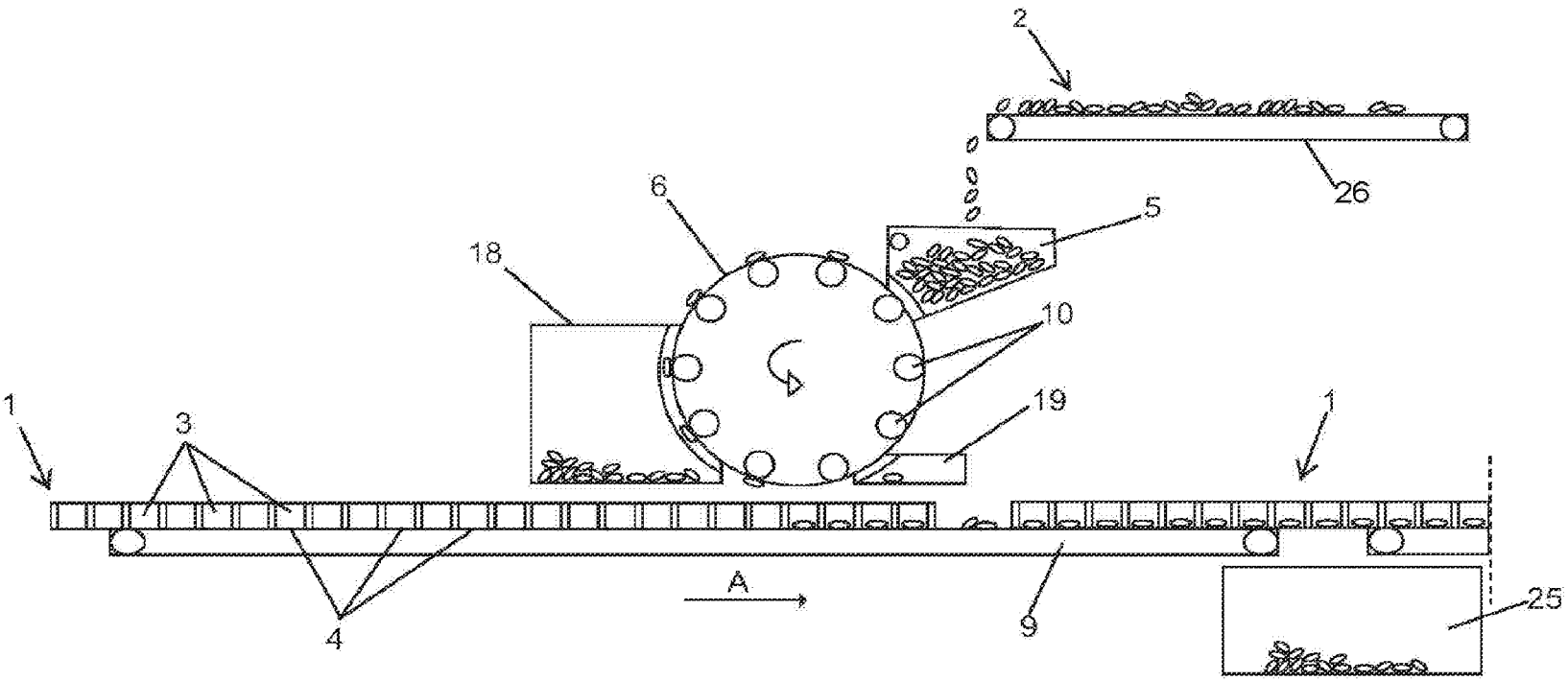
FIG. 2 shows a schematic plan view of the machine for filling containers with insect larvae.
Figure 3:
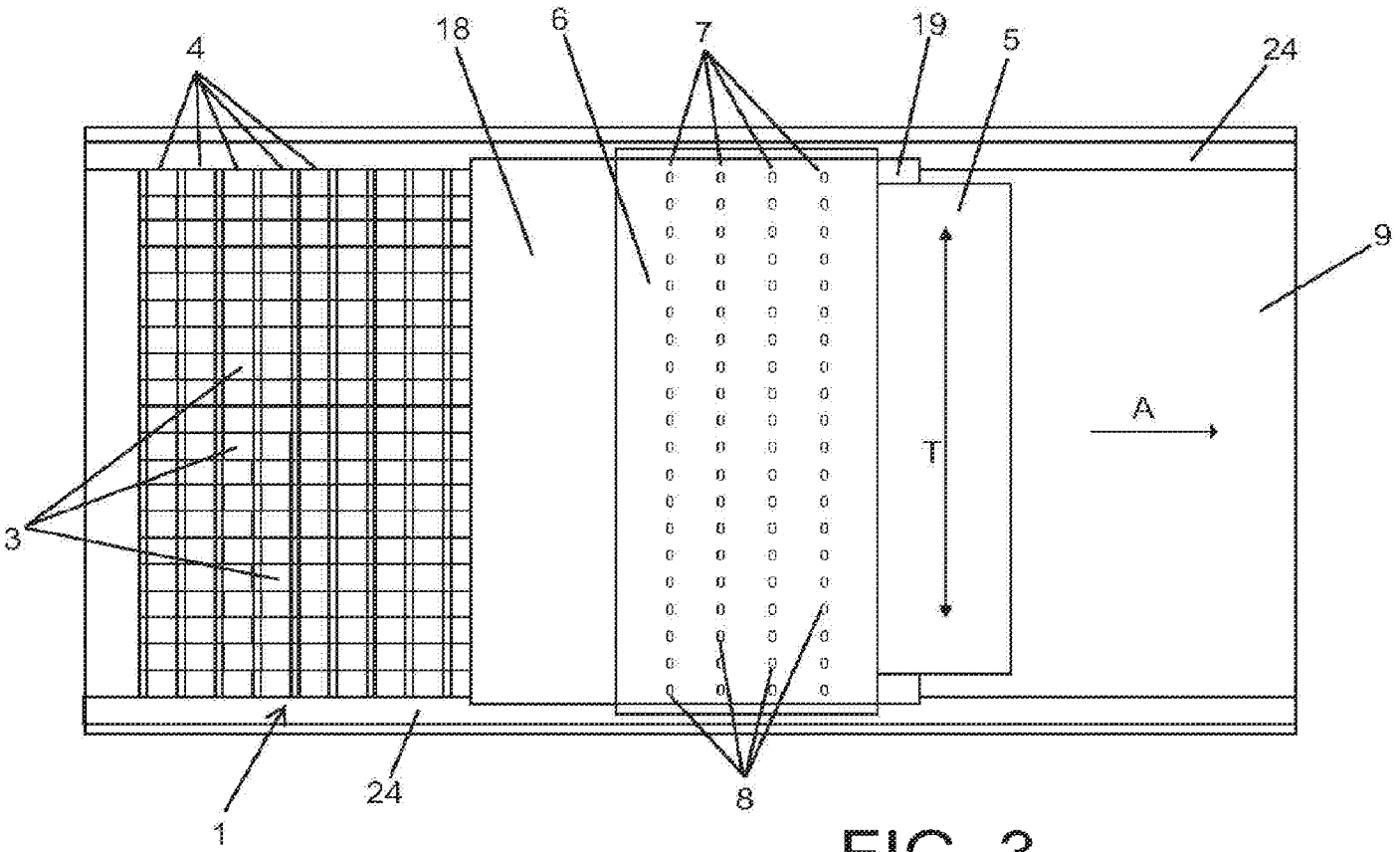
FIG. 3 shows a schematic elevational view of the machine for filling containers with insect larvae.
Figure 4:
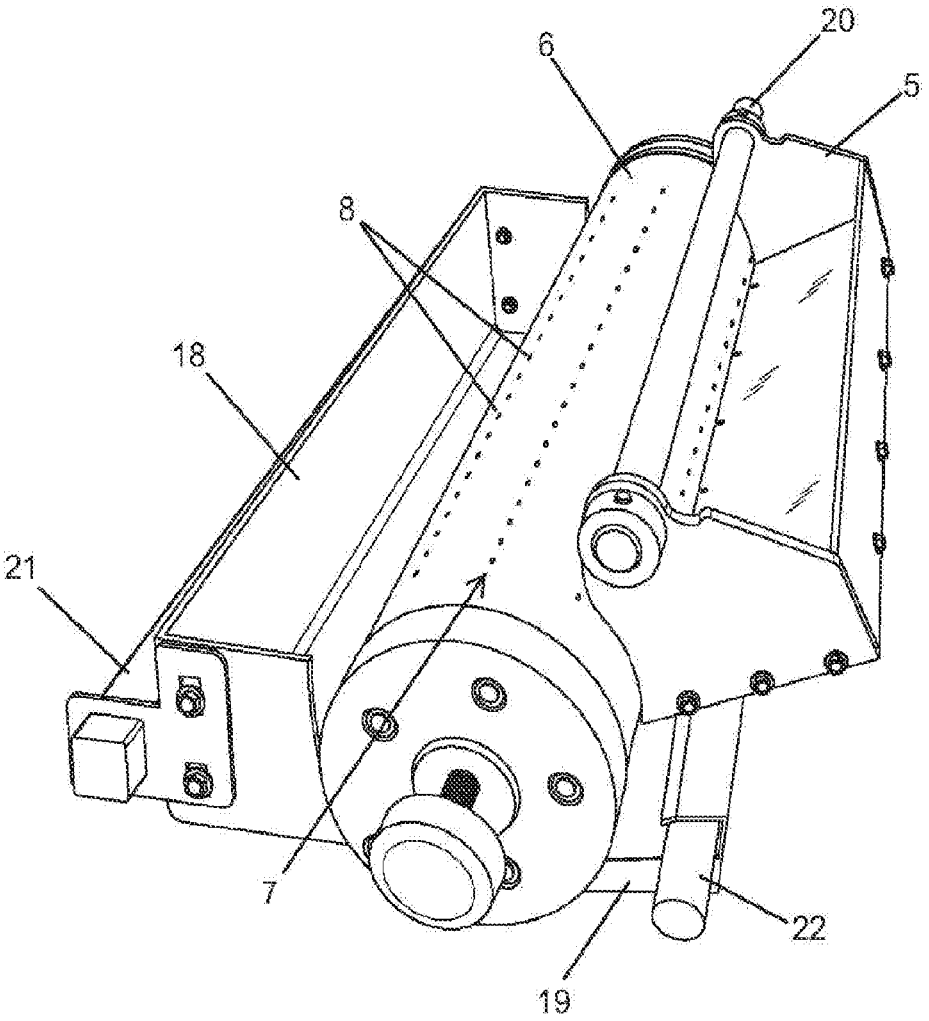
FIG. 4 shows a perspective view of the loading hopper and the roller used to individually arrange the larvae in the compartments of the container.

As observed in detail in FIGS. 2 and 3, the container 1 has a plurality of compartments 3 distributed in rows 4 for receiving a larva 2 in each compartment 3.

Figure 1:
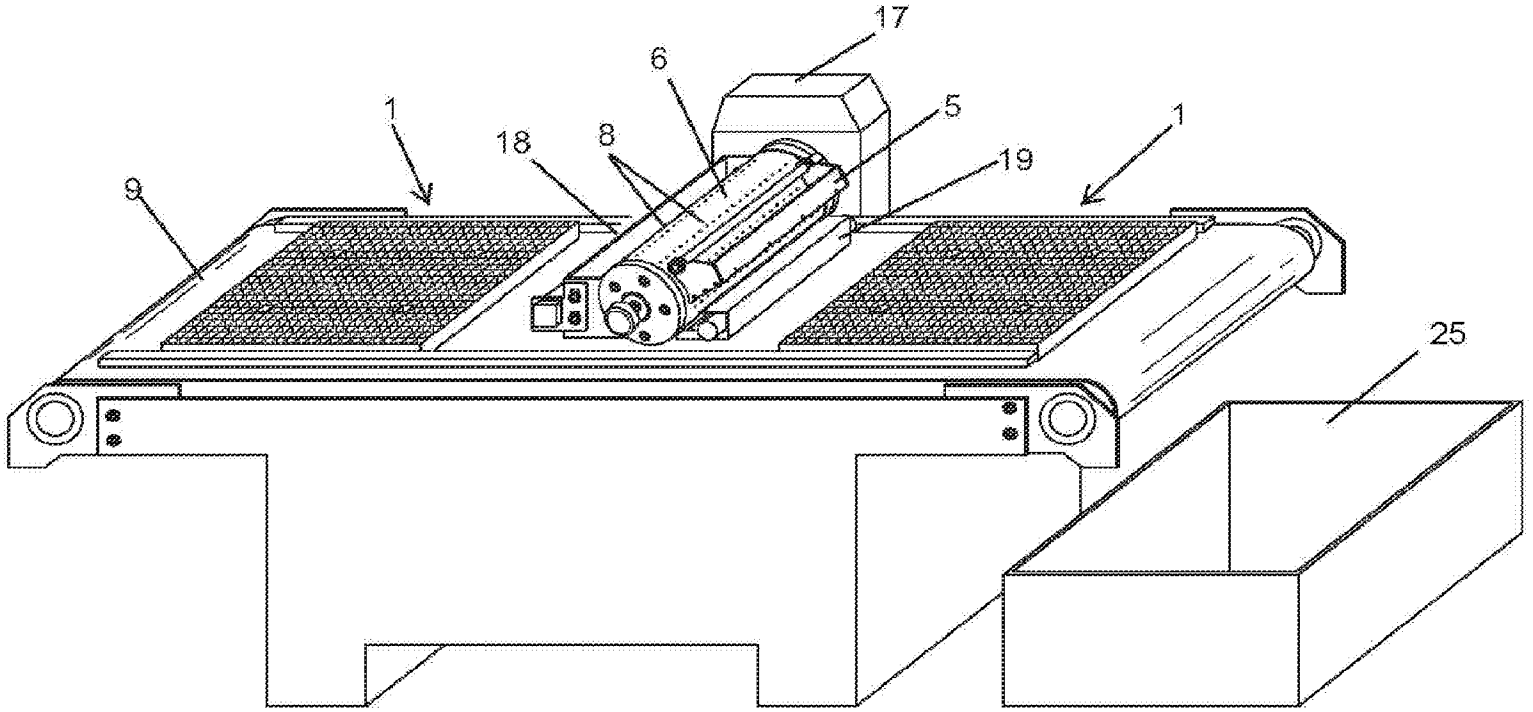
FIG. 1 shows a perspective view of a machine for filling containers with insect larvae according to an example of the invention.

As shown in the example of FIGS. 1 and 2, the machine comprises a hopper 5 for receiving the larvae 2, a roller 6 which is arranged adjacent to the hopper 5 and has lines 7 of openings 8 on its outer surface for adhering a larva 2 at each opening 8, a vacuum pump (not depicted) for applying a vacuum inside the roller 6 and adhering the larvae 2 to the openings 8, a conveyor belt 9 for moving the container 1 according to a forward movement direction A towards the roller 6, the container 1 being moved through an area below the roller 6 and the roller 6 being arranged in a transverse position with respect to the forward movement direction A of the container 1, and rotation means (not depicted) for rotating the roller 6 in a manner that is synchronized with the forward movement of the container 1 from a loading position in which the larvae 2 from the hopper 5 are adhered to the openings 8 of the roller 6 to an unloading position in which one of the lines 7 of openings 8 of the roller 6 faces the compartments 3 of one of the rows 4 of the container 1, such that when the vacuum is removed from the line 7 of openings 8 in the unloading position, the larvae 2 are released, with one larva 2 being arranged in each compartment 3 of the row 4 of the container 1.

Preferably, the number of compartments 3 of a row 4 of the container 1 coincides with the number of openings 8 of a line 7 of the roller 6. Depending on production needs, containers 1 with a different number of compartments 3 can be used.

The roller 6 has channels 10 inside, each channel 10 is in fluid communication with one of the lines 7 of openings 8, and one of the ends of the roller 6 is rotatably attached to a fixed collector 11 having a first sector 12 that is in fluid communication with the vacuum pump, such that during the rotation of the roller 6 a vacuum is applied to the openings 8 of the channels 10 that are connected to the first sector 12, with the vacuum being absent in the rest of the openings 8. See FIG. 6.

The channels 10 are arranged on the radial periphery of the roller 6 and extend parallel to the axial shaft 16 of the roller 6. The channels 10 are aligned with the lines 7 of openings 8 and are equally spaced from one another. Preferably, the roller 6 has the same number of lines 7 as channels 10, and preferably the number of openings 8 in each line 7 of the roller 6 corresponds to the number of compartments 3 in each row 4 of the container 1.

The first sector 12 has an angular distribution and extends between the loading position, in which the larvae 2 are loaded into the hopper 5, and a position immediately preceding the unloading position, in which the larvae 2 are released. During the rotation of the roller 6, a vacuum is thereby applied to the openings 8 of the roller 6 between the loading position and the position immediately preceding the unloading position, and the vacuum is no longer applied to the openings 8 in the unloading position.

Figure 6:
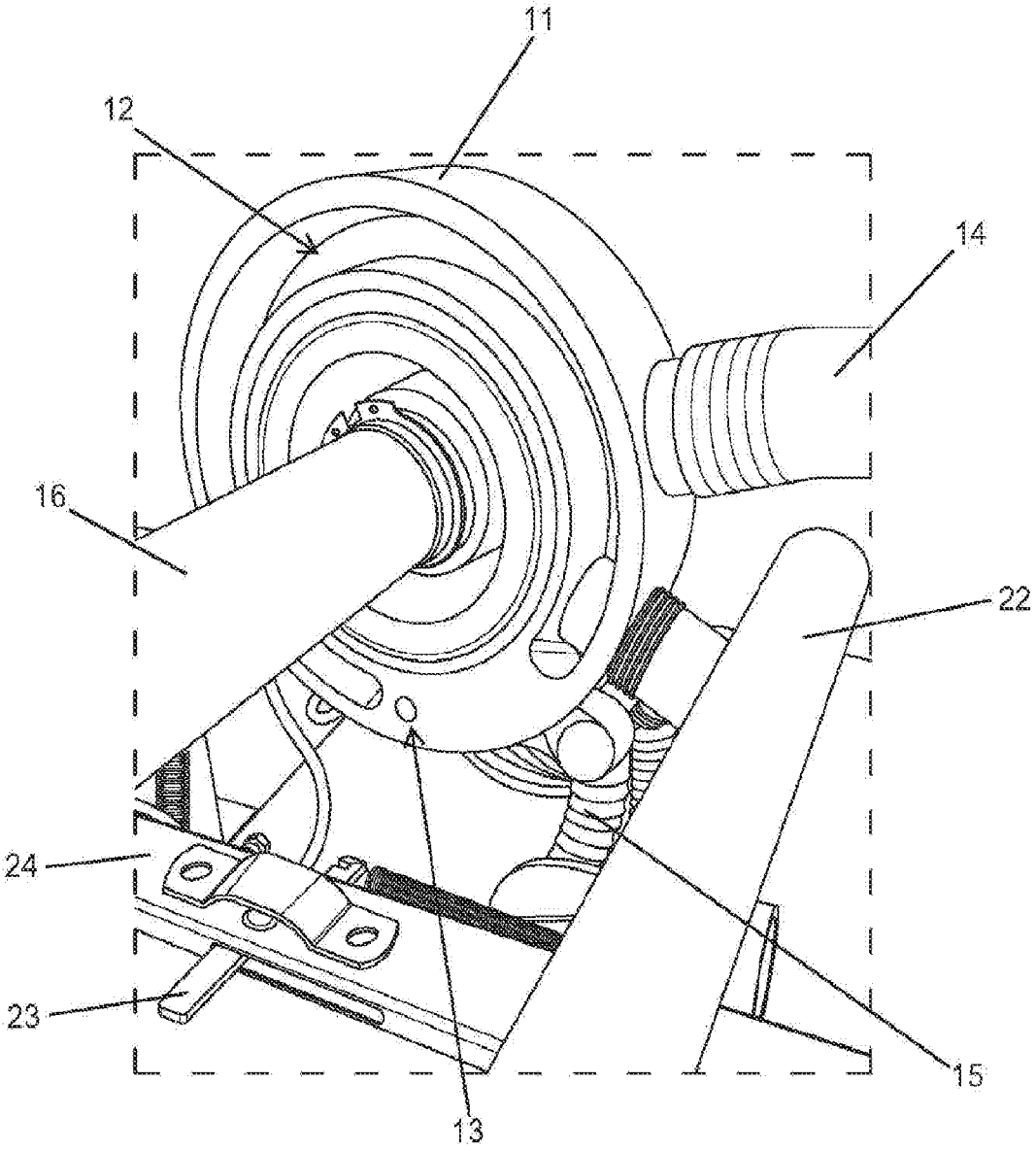
FIG. 6 shows a perspective view of the fixed collector where one end of the roller is connected for applying a vacuum inside the roller that allows the larvae to adhere to the openings of the roller.

Preferably, as seen in the example of FIG. 6, the fixed collector 11 has a second sector 13 arranged in the unloading position that is in fluid communication with air injection means (not depicted), such that during the rotation of the roller 6, air is injected into the openings 8 of the channel 10 that are connected to the second sector 13. An air stream thereby forces the larvae 2 to detach from the roller 6, which is preferable, since the larvae 2 tend to be adhered to the surface of the roller 6.

Alternatively, the second sector 13 is not connected to air injection means, so that during the rotation of the roller 6, a vacuum is not applied to the second sector 13, and the larvae 2 are no longer adhered to the openings 8 of the roller 6, with the larvae 2 being discharged by gravity.

As shown in FIG. 6, a first hose 14 connects the first sector 12 of the fixed collector 11 to the vacuum pump, and a second hose 15 connects the second sector 13 to the air injection means, preferably with a compressed air intake.

The openings 8 of the roller have a diameter of between 0.5 mm and 2 mm and the vacuum pump is configured to apply a vacuum through the openings 8 of between 0.2 bar and 0.7 bar. The larvae 2 are thereby adhered to the openings 8 but are not sucked through the openings 8.

The conveyor belt 9 is arranged in a position below the roller 6, and the roller 6 is attached to the frame 17 of the machine, the roller 6 being arranged in a position above the conveyor belt 9. The roller 6 is cantilevered over the conveyor belt 9.

The axial shaft 16 of the roller 6 is rotatably driven by the rotation means, which are a motor that rotatably drives the axial shaft 16. The conveyor belt 9 is driven by another motor, and by means of a control unit the forward movement speed of the conveyor belt 9 and the rotation of the roller 6 are regulated to sequentially align the lines 7 of openings 8 of the roller 6 with the rows 4 of compartments 3 of container 1 and depositing a larva 2 in each compartment 3.

The machine further comprises a first collection tray 18 which is arranged adjacent to the roller 6 in a position that is between the loading position and a position immediately preceding the unloading position, according to the rotation of the roller 6, to collect by gravity larvae 2 that are adhered to the outer surface of the roller 2 without being adhered to the openings 8.

The machine further comprises a second collection tray 19 which is arranged adjacent to the roller 6 in a position below the hopper 5 and vertically aligned with the hopper 5, to collect larvae 2 that slip through a space between the hopper 5 and the roller 6.

The hopper 5 and the collection trays 18 and 19 are arranged adjacent to the roller 6 and separated by a distance, said distance being approximately the thickness of a larva to allow rotation of the roller with respect to the hopper 5 and the trays 18 and 19 without damaging the larvae 2.

Figure 5:
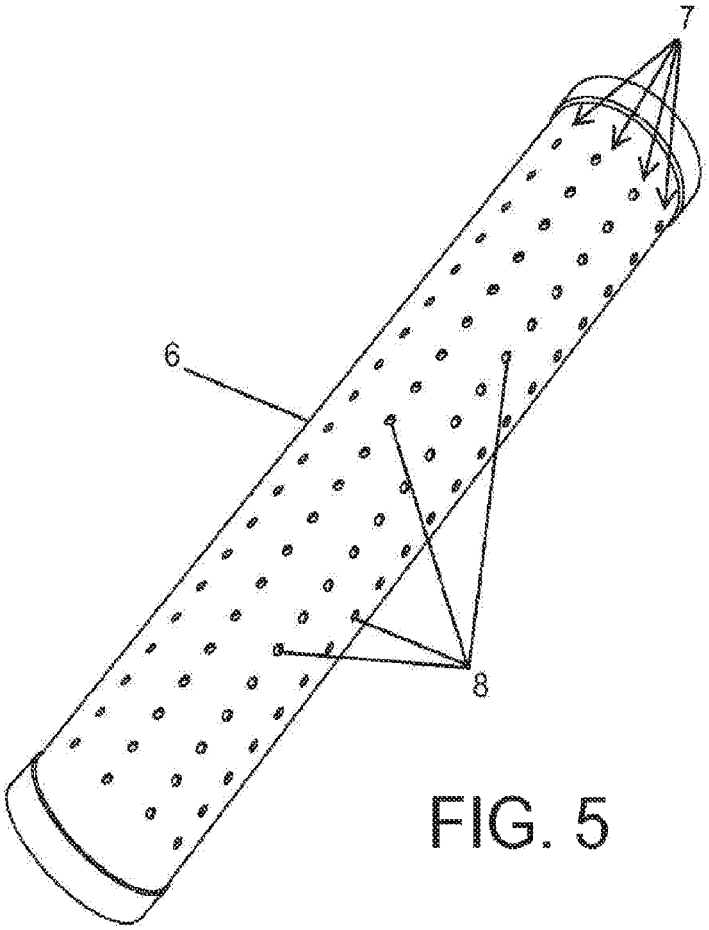
FIG. 5 shows a perspective view of the roller in the previous figure where the lines of openings can be seen.

The hopper 5 is arranged on a moving shaft 20 to move the hopper 5 with respect to the roller 6 according to a back-and-forth movement in a transverse direction T with respect to the forward movement direction A (see FIGS. 3 and 5) and distribute the larvae 2 on the roller 6. The hopper 5 thus oscillates with respect to the roller 6, allowing the larvae 2 from the hopper 5 to be distributed along the outer surface of the roller 6. The moving shaft 20 is attached to the frame 17 and supports the hopper 5 while allowing back-and-forth movement. The hopper 5 is cantilevered over a part of the outer surface of the roller 6.

The first collection tray 18 is supported on a first beam 21 which is attached to the frame 17. The first collection tray 18 is arranged cantilevered over the conveyor belt 9 and in a position below a part of the roller 6. The second collection tray 19 is supported on a second beam 22 which is attached to the frame 17. The second collection tray 19 is cantilevered over the conveyor belt 9 and in a position below a part of the roller 6 and in a position below the hopper 5 and vertically aligned with the hopper 5.

The machine further comprises a sensor 23 arranged downstream of the roller 6 according to the forward movement direction A of the container 1, the rotation of the roller 6 being maintained while the sensor 23 is active. Preferably, the sensor 23 is a limit switch which is arranged on one side of the conveyor belt 9 and is configured to contact the container 1. See FIG. 6.

The conveyor belt 9 has guides 24 on both sides that guide the containers 1 in the forward movement direction A. The sensor 23 is arranged on one guide 24, or both guides 24, and downstream of the roller 6.

The machine further comprises a collection drawer 25 which is arranged upstream of the roller 6 at one end of the machine and in a position below the conveyor belt 9. The drawer 25 allows the recovery of larvae 2 that may have fallen out of the container 1 onto the conveyor belt 9. See FIGS. 1 and 2.

The larvae 2 are supplied to the hopper 5 automatically through a conveyor belt 26 which is arranged in a position above the hopper 5. See FIG. 2.

Therefore, as shown in FIGS. 7*a*-7*d*, the process for filling a container 1 with insect larvae 2 comprises the following phases:

Supplying the larvae 2 to a hopper 5 which is arranged adjacent to a roller 6 having lines 7 of openings 8 on the outer surface thereof for adhering a larva 2 at each opening 8.

Applying a vacuum inside the roller 6 for adhering the larvae 2 to the openings 8. See FIG. 7*a*.

Moving the container 1 in a forward movement direction A towards the roller 6, the container 1 being moved through an area below the roller 6 and the roller 6 being arranged in a transverse position with respect to the forward movement direction A, and rotating the roller 6 in a manner that is synchronized with the forward movement of the container 1 from a loading position in which the larvae 2 from the hopper 5 are adhered to the openings 8 of the roller 6 to an unloading position in which one of the lines 7 of openings 8 of the roller 6 faces the compartments 3 of one of the rows 4 of the container 1. See FIG. 7*b*.

Removing the vacuum from the line 7 of openings 8 in the unloading position in order to release the larvae 2, with one larva 2 being arranged in each compartment 3 of the row 4 of the container 1. See FIG. 7*c*.

Preferably, the vacuum is removed from the line 7 of openings 8 in the unloading position and an air stream is applied through those openings 8 in the unloading position, expelling the larvae 2 towards the compartments 3 of the container 1.

Figure 7A:
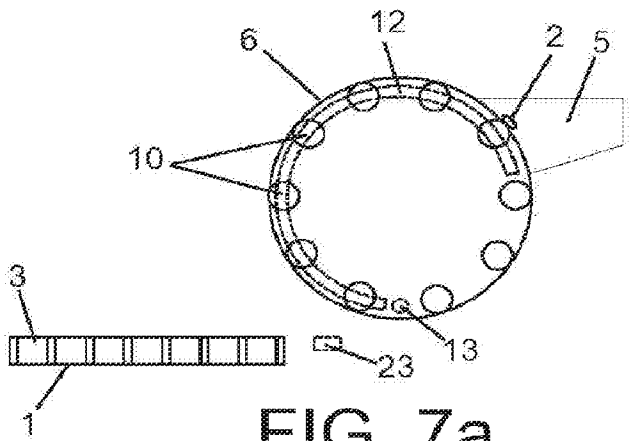
FIGS. 7*a*-7*d* show the process for adhering the larvae to the roller and placing one larva in each compartment of the container.
Figure 7B:
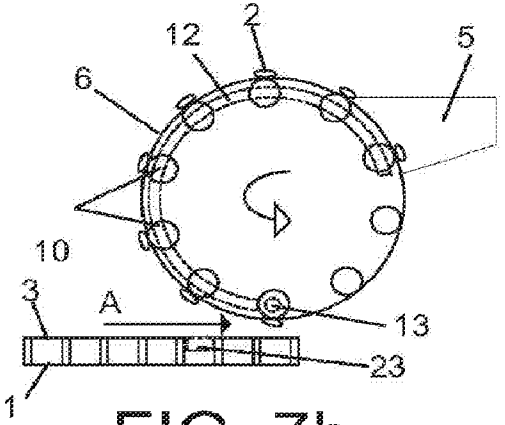
Figure 7C:
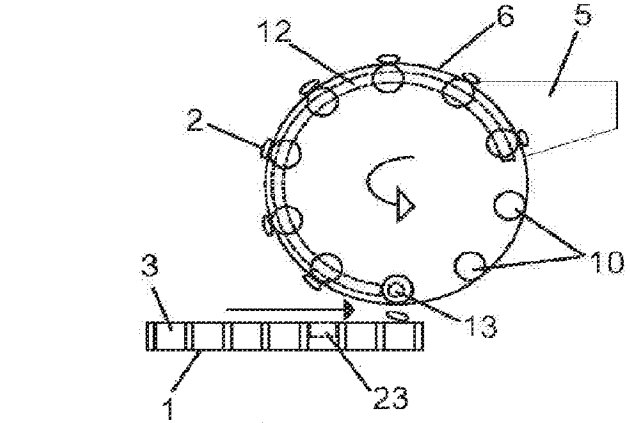
Figure 7D:
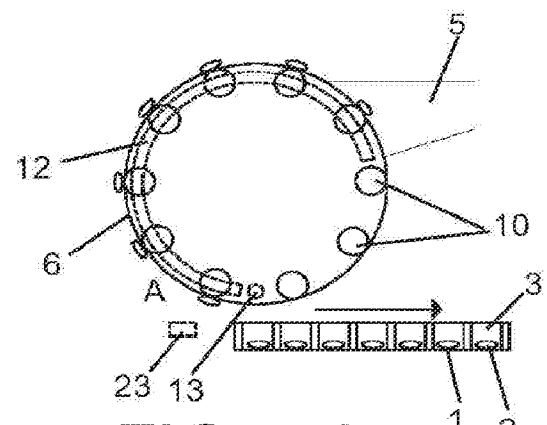

As shown in FIG. 7*b*, the larvae 2 from the hopper 5 are adhered to the openings 8 of the lines 7 during the rotation of the roller 6 from the loading position to a position immediately before the unloading position. During this travel of the roller 6, from the loading position to the unloading position, some of the channels 10 are in fluid communication with the first sector 12 of the fixed collector 11, so that all the openings 8 associated with said channels 10 have a larva 2 adhered thereto. When a channel 10 reaches the unloading position, it is no longer subjected to a vacuum and enters into fluid communication with the second sector 13 of the fixed collector 11, applying an air stream through said channel 10 to expel the larvae 2 adhered to the openings 8 of said channel 10 which is in the unloading position, as shown in FIG. 7*c*.

The container 1 activates the sensor 23 which is arranged downstream of the roller 6 according to the forward movement direction A of the containers 1, the rotation of the roller 6 being maintained while the sensor 23 is active. The forward movement of container 1 thereby causes the roller 6 to continue rotating and the lines 7 of openings 8 to sequentially reach the unloading position, and to be aligned with the rows 4 of compartments 3 of the container 1. The rotation of the roller 6 is maintained as long as sensor 23 detects the presence of a container 1, and therefore until all the compartments 3 of the container 1 are filled with a larva 2. When the container 1 stops contacting the sensor 23, the rotation of the roller 6 stops, and the forward movement of the container 1 on the conveyor belt 9 continues until it is discharged from the machine. See FIG. 7*d*.

The invention claimed is:

1. A process for filling a container with insect larvae, wherein the container has a plurality of compartments distributed in rows for receiving a larva in each compartment, the process comprising:

supplying the larvae to a hopper which is arranged adjacent to a roller having lines of openings on the outer surface thereof for adhering a larva at each opening, applying a vacuum inside the roller for adhering the larvae to the openings, moving the container in a linear forward movement direction towards the roller, the container being moved through an area below the roller and the roller being arranged in a transverse position with respect to the forward movement direction, rotating the roller in a manner that is synchronized with the forward movement of the container from a loading position in which the larvae from the hopper are adhered to the openings of the roller to an unloading position in which one of the lines of openings of the roller faces the compartments of one of the rows of the container, and removing the vacuum from the line of openings in the unloading position in order to release the larvae, with one larva being arranged in each compartment of the row of the container.

2. The process according to claim 1, wherein the vacuum is removed from the line of openings in the unloading position and an air stream is applied through those openings in the unloading position, expelling the larvae towards the compartments of the container.

3. The process according to claim 1, wherein the container activates a sensor which is arranged downstream of the roller according to the forward movement direction of the containers, the rotation of the roller being maintained while the sensor is active.

4. The process according to claim 1, wherein the hopper moves with respect to the roller according to a back-and-forth movement in a transverse direction with respect to the forward movement direction to distribute the larvae from the hopper onto the roller.

5. The process according to claim 1, wherein the vacuum is of between 0.2 bar and 0.7 bar and is applied through the openings that have a diameter of between 0.5 mm and 2 mm.

* * * * *